United States Patent [19]

Ganz

[11] 4,263,725

[45] Apr. 28, 1981

[54] SHRINK TUNNEL

[75] Inventor: Robert H. Ganz, Saddle River, N.J.

[73] Assignee: Ganz Brothers, Inc., Bergenfield, N.J.

[21] Appl. No.: 54,406

[22] Filed: Jul. 3, 1979

[51] Int. Cl.[3] ..... F26B 15/18

[52] U.S. Cl. ..... 34/231; 34/233

[58] Field of Search ..... 53/442, 557; 34/225, 34/233, 224, 232, 231

[56] References Cited

U.S. PATENT DOCUMENTS

| | | | |
|---|---|---|---|
| 3,222,800 | 12/1965 | Siegel et al. | 34/233 |
| 3,309,835 | 3/1967 | Peppler | 53/557 |
| 3,399,506 | 9/1968 | Howe, Jr. | 34/225 |

*Primary Examiner*—Larry I. Schwartz

*Attorney, Agent, or Firm*—Charles E. Brown

[57] ABSTRACT

This invention relates to a shrink tunnel for heat shrinking film about products to form packages. Most particularly, this invention relates to a shrink tunnel for forming a package of a plurality of cans having a shrink film wrapped thereabout. The tunnel is particularly adapted for effecting the required shrinking of the shrink film about the cans to form a tight package while at the same time being so constructed to prevent undue distortion of a central portion of the shrink wrap whereby the shrink wrap may have a universal product code preprinted thereon with the product being substantially undistorted and readily scannable by a conventional electronic scanner to determine product identification and price.

12 Claims, 4 Drawing Figures

SHRINK TUNNEL

This invention relates in general to new and useful improvements in shrink tunnels for shrinking heat shrinkable plastic films about a product(s) to form a tight package. Most particularly, this invention relates to a shrink tunnel which is adapted for shrinking a shrink film about a product(s) wherein the shrink film has preprinted thereon a universal product code (UPC) for identifying the product and the place thereof by means of an electronic scanner.

It is the function of all heat tunnels to controllably heat and thereby shrink a heat shrinkable film about a product(s) with a minimum of distortion of the film. However, in the past, particularly when the products are containers, there has been a certain distortion or uneven stretching and shrinking of the film so as to result in at least a certain undesirable degree of distortion of any printing which is preplaced upon the film.

At the present there is a desire to place on the packages being formed the UPC code at the time the product packages are formed. It is therefore highly desirable that the distortion of the shrunk film be held to a minimum, particularly in the area where the UPC code is applied. This invention has to do with a shrink tunnel which provides for the desired uniform shrinkage of the shrink film.

With the above and other objects in view that will hereinafter appear, the nature of the invention will be more clearly understood by reference to the following detailed description, the appended claims and the several views illustrated in the accompanying drawings.

Figure 1:
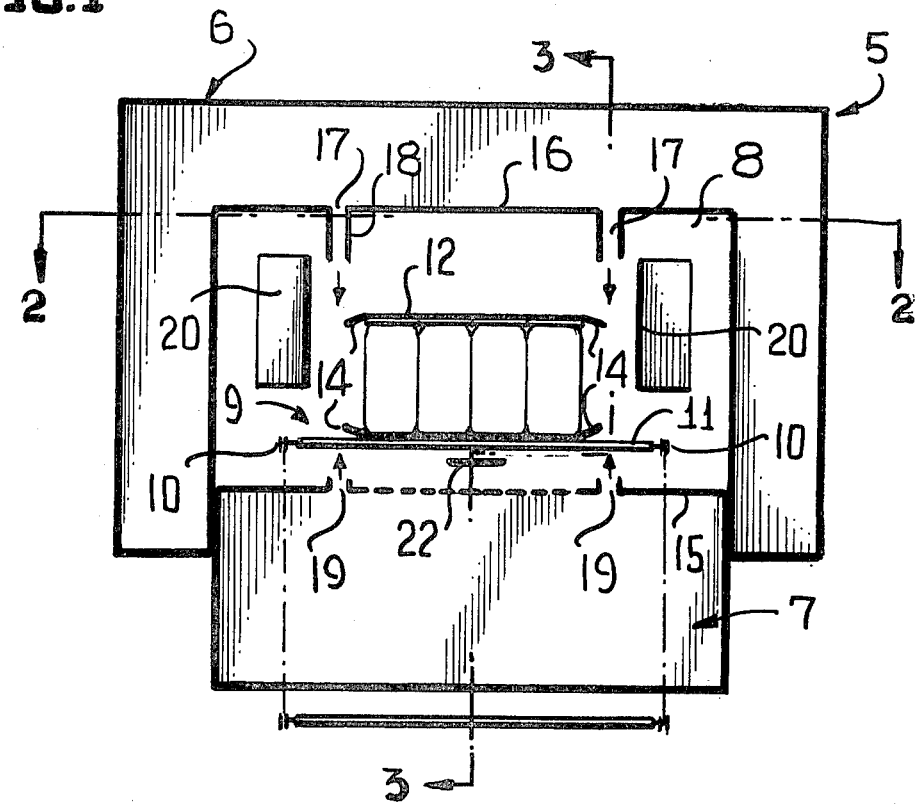
FIG. 1 is an end elevational view of the shrink tunnel of this invention from the product exit end thereof.

Referring now to the drawings in detail, it will be seen that there is illustrated the shrink tunnel which is the subject of this invention, the shrink tunnel being generally identified by the numeral 5. The shrink tunnel 5 includes an inverted generally U-shaped housing 6 which together with a generally rectangular housing 7 defines a longitudinally elongated tunnel 8.

Basically, the shrink tunnel 5 is of a conventional construction except for certain specific details. Accordingly, the internal workings of the housings 6 and 7 will not be described here except to indicate that either contained therein or associated therein are suitable blower means and suitable means for heating the air to a prescribed temperature, as well as means for effecting recirculation of the air through the housings 6 and 7. If necessary, the housing 6 may be vertically adjusted relative to the housing 7.

The tunnel also has extending therethrough a product conveyor, generally identified by the numeral 9. The product conveyor 9 is also of a conventional type and includes a pair of transversely spaced chains 10 and suitable product support 11 extending therethrough.

The product support 11 may be in the form of transverse bars which are longitudinally spaced or may be in the form of a perforated mesh-like material. In any event, it is necessary that hot air be able to be directed upwardly through the conveyor 9.

Figure 3:
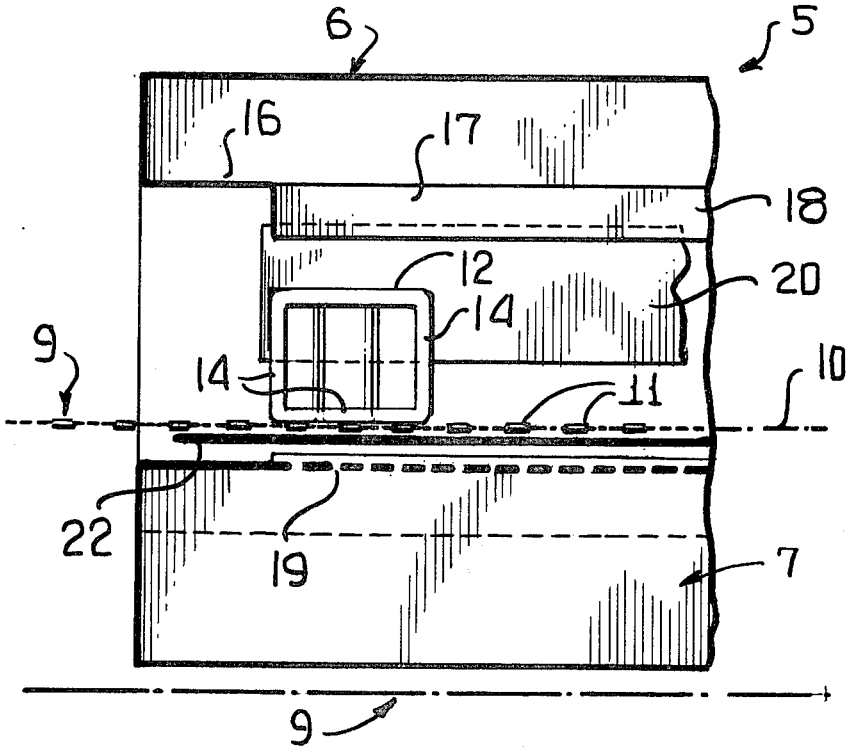
FIG. 3 is a fragmentary longitudinal vertical sectional view taken generally along the line 3—3 of FIG. 1 and shows further the details of the product package and the shrink tunnel.

In accordance with this invention, the product which is to be packaged is moved longitudinally and a heat shrinkable film 12 is wrapped longitudinally thereabout with ends of the film being disposed in overlapping relation in a transversely extending seam, as is best shown in FIG. 3. The overlapped end portions of the shrink film 12 are heat bonded together by the application of hot air.

It is to be understood that the shrink film 12 is of a transverse dimension greater than the product so as to have initially transversely extending end portions 14. Hot air is primarily directed against the end portions 14 to effect shrinkage thereof tightly about the ends of the packaged products.

Most specifically, in accordance with this invention, the products to be packaged are containers of the can type. Further, while various numbers of cans may be packaged, the present shrink tunnel has proven to be particularly adaptable in a package of twelve cans with the cans being arranged in four longitudinal rows of three cans each thus forming a $4 \times 3$ package.

The housing 7 is provided with a perforated top wall 15 through which air is directed upwardly against the underside of the shrink film 12. This is also generally conventional.

One important feature of the invention is that no hot air is directed against the top of the package except against the projecting end portions 14. This is accomplished by providing a top wall 16 for the tunnel 8 that is imperforate except for two longitudinally extending slots 17. The slots 17 are defined by downwardly projecting narrow panels which are arranged in pairs and are disposed generally a quarter of an inch or the like apart. These openings 17 in the panels 18 are disposed in parallel relation and extend longitudinally of the tunnel 8 for substantially the full length thereof.

It is particularly noted that the slots 17 are so transversely spaced so as to be disposed transversely outwardly of the product and generally in alignment with the projecting portions 14 of the shrink wrap 12.

It is also preferred, but not absolutely necessary, that the perforated top wall 15 of the housing 7 also include a pair of longitudinal slots 19 which are generally aligned with the slots 17 and which provide for upwardly directed walls of hot air also directed against the projecting portions 14 of the shrink wrap.

Figure 2:
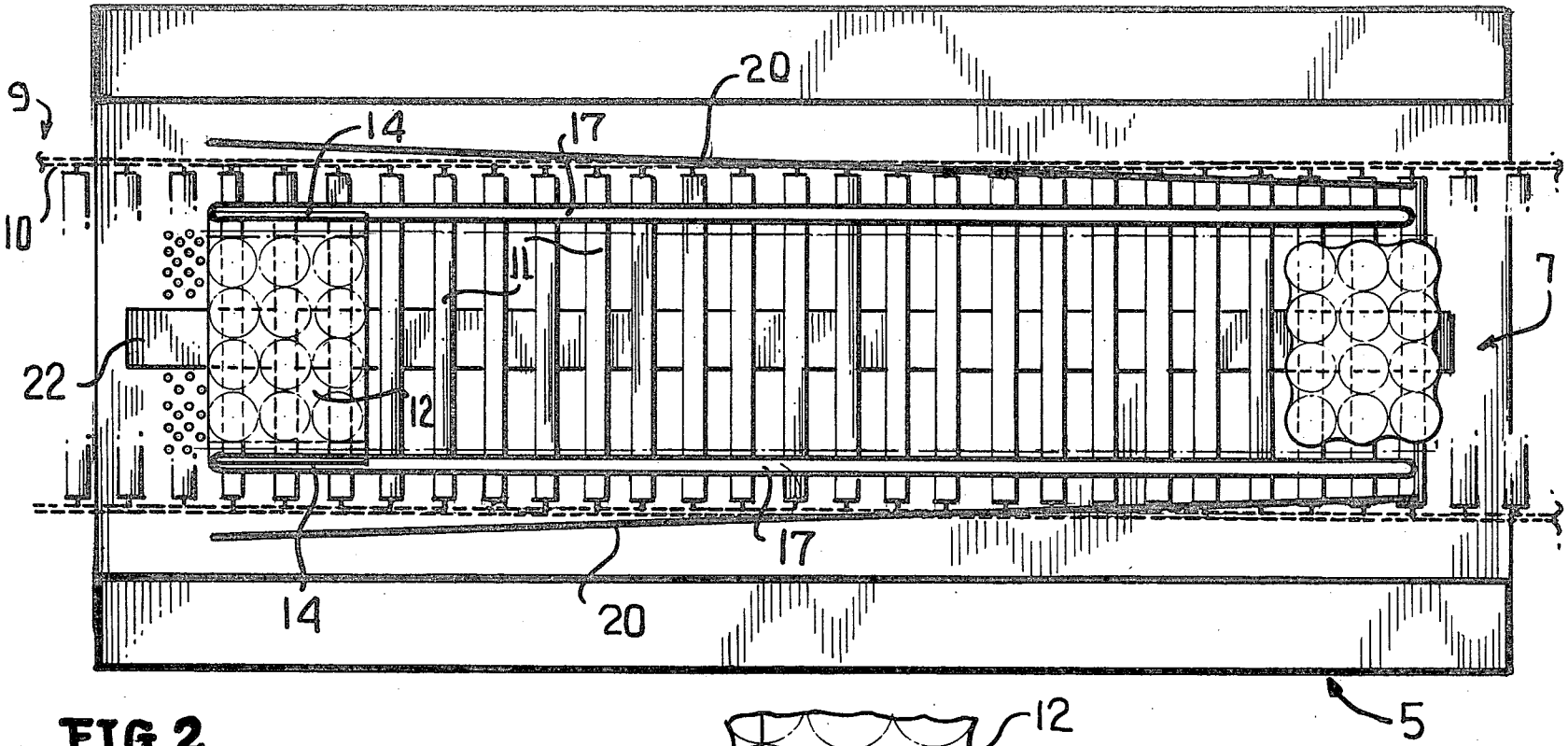
FIG. 2 is a longitudinal horizontal sectional view taken generally along the line 2—2 of FIG. 1 and shows the general details of the shrink tunnel on a reduced scale.

It has been further found beneficial to provide a pair of upstanding baffles 20 disposed vertically between the walls 15 and 16 and preferably in spaced relation with respect thereto. The baffles 20 are spaced transversely outwardly of the slots 18 and serve to redirect any reflected hot air towards the projecting portions 14 of the shrink wrap 12. It is to be particularly noted from FIG. 2 that the baffles 20 converge transversely from the entrance end to the exit end of the tunnel 8.

Figure 4:
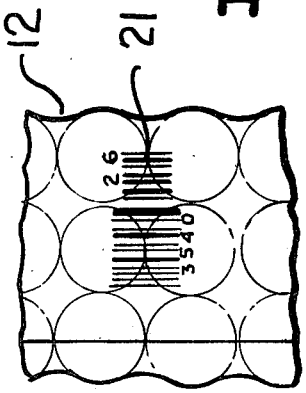
FIG. 4 is a fragmentary bottom plan view of a product package formed in accordance with this invention and having imprinted thereon the UPC code.

As pointed out above, it is preferred that at the time the package is formed the shrink wrap have imprinted thereon the conventional universal product code UPC for indicating by way of an electronic scanner the identification of the product and the price. Such UPC code is conventional and is generally illustrated in FIG. 4 and identified by the numeral 21. The code 21 is preferably preprinted on the shrink film 12 with the feeding of the film around the product being packaged being so controlled so that the code appears on the bottom panel of the resultant shrink wrap, as is clearly shown in FIG. 4. Since the code 21 is preprinted, and since the code must remain substantially as printed without distortion, it is necessary that the portion of the shrink film 12 carrying the printed code 21 be substantially free of distortion due to shrinkage.

By directing the primary flow of hot air against the end portions 14 of the shrink film or wrap, and by not directing any hot air against the top panel of the shrink wrap, distortion of the central portion of the wrap in a longitudinal direction is substantially eliminated. It has been found that by further providing a narrow horizontal baffle 22 which extends longitudinally of the tunnel 8 in alignment with the printed code 21 and by placing that baffle above the top wall 15 of the housing 7 and in an out-of-the-way position beneath the conveyor 11 and the product being packaged, hot air from the housing 7 is prevented from directly impinging upon the central portion of the wrap and thereby the central portion remains substantially distortion free, even along the bottom panel thereof.

Inasmuch as the product being packaged is moved along a predetermined path by the conveyor 11, it will be seen that the product is accurately positioned as it moves through the shrink tunnel 5. Thus the printed code 21 moves along a predetermined path and remains aligned with the horizontal baffle 22 at all times. Thus accuracy of protection is assured.

The net result of the passage of a product and a shrink film wrapped thereabout through the shrink tunnel 5 in the manner illustrated is the formation of a very tight package wherein the ends of the shrink wrap are tightly shrunk relative to the product while the central portion of the wrap remains substantially undistorted and with the printed code 21 on the underside thereof being sufficiently undistorted so as to be properly viewable by a conventional scanner.

Although only a preferred embodiment of the invention has been specifically illustrated and described herein, it is to be understood that minor variations may be made in the shrink tunnel without departing from the spirit and scope of the invention as defined by the appended claims.

I claim:

1. A shrink tunnel for forming shrink wrap packages of the type wherein a shrinkable film carrying a product code is wrapped about a product and then heat shrunk to tightly fit the product, said shrink tunnel comprising an elongated tunnel-like housing, a conveyor for moving packages in sequence through said housing along a preselected path, means for introducing hot air into said housing including upwardly through said conveyor, and a narrow baffle underlying said conveyor and extending longitudinally through said housing in alignment with a prescribed portion of said path for protecting said product code carried by the shrinkable film against shrinkage and resultant distortion.

2. A shrink tunnel for forming shrink wrap packages of the type wherein a shrinkable film is wrapped about a product while allowing end portions of said film to project past the package and then heat shrunk to tightly fit the product, said shrink tunnel comprising an elongated tunnel-like housing, a conveyor for moving packages in sequence through said housing along a preselected path, means for introducing hot air into said housing including upwardly through said conveyor; said means for itroducing hot air including a top wall having therein two transversely spaced, longitudinally extending, and downwardly openin air slots spaced transversely outwardly of said preselected path for directing hot air onto said projecting end portions of said shrink wrap.

3. The shrink tunnel of claim 2 wherein said slots form the sole means for directing hot air into said housing from said top wall.

4. The shrink tunnel of claim 3 together with vertical baffles extending longitudinally through said housing on opposite sides of said path and transversely outwardly of said slots and transversely inwardly of side walls of said housing.

5. The shrink tunnel of claim 4 wherein said housing includes an entrance end and an exit end, and said baffles converge toward said exit end.

6. The shrink tunnel of claim 4 wherein said housing includes an entrance end and an exit end, and said baffles converge toward said exit end with said slots being in parallel relation.

7. The shrink tunnel of claim 2 together with vertical baffles extending longitudinally through said housing on opposite sides of said path and transversely outwardly of said slots and transversely inwardly of side walls of said housing.

8. The shrink tunnel of claim 7 wherein said housing includes an entrance end and an exit end, and said baffles converge toward said exit end.

9. The shrink tunnel of claim 8 wherein said housing includes an entrance end and an exit end, and said baffles converge toward said exit end with said slots being in parallel relation.

10. The shrink tunnel of claim 2 wherein said means for introducing hot air includes means for introducing upwardly directed hot air including two streams opposing said slots.

11. The shrink tunnel of claim 10 together with vertical baffles extending longitudinally through said housing on opposite sides of said path and transversely outwardly of said slots and transversely inwardly of side walls of said housing.

12. The shrink tunnel of claim 10 together with a narrow baffle underlying said conveyor and extending longitudinally through said housing in alignment with a prescribed portion of said path for protecting a product code carried by the shrinkable film against shrinkage and resultant distortion.

* * * * *